US005082122A

United States Patent [19]

Connor, Jr. et al.

[11] Patent Number: 5,082,122

[45] Date of Patent: Jan. 21, 1992

[54] UNIT FOR DISPLAYING A PLURALITY OF ITEMS IN HOLDERS

[75] Inventors: Charles M. Connor, Jr.; John K. Connor; H. B. Stroup, Jr., all of Asheville, N.C.

[73] Assignee: Collector's Products Corporation, Asheville, N.C.

[21] Appl. No.: 499,161

[22] Filed: Mar. 26, 1990

[51] Int. Cl.[5] ..... A47G 19/08

[52] U.S. Cl. ..... 211/41; 40/124

[58] Field of Search ..... 211/41, 194, 44; 40/159.2, 605, 323, 124, 618, 620

[56] References Cited

U.S. PATENT DOCUMENTS

| | | | |
|---|---|---|---|
| 1,238,988 | 9/1917 | Connor | 40/124 |
| 1,748,419 | 2/1930 | Hurley | 40/124 |
| 3,230,651 | 1/1966 | Navarro | 40/124 |
| 3,565,152 | 1/1971 | Cohn | 40/605 X |
| 3,878,633 | 4/1975 | McWilliams | 40/124 X |
| 4,497,125 | 2/1985 | Hutchinson | 40/124 X |
| 4,505,061 | 3/1985 | Neuburger et al. | 40/605 X |
| 4,545,142 | 10/1985 | Whisnant | 40/605 |
| 4,565,290 | 1/1986 | Corrigan et al. | 211/41 |
| 4,751,612 | 6/1988 | Smith | 211/41 X |
| 4,759,451 | 7/1988 | Apps | 211/194 X |

*Primary Examiner*—Blair M. Johnson

*Attorney, Agent, or Firm*—Dougherty, Ralph H.

[57] ABSTRACT

A display unit is disclosed for displaying a plurality of display items contained in holders. Each display unit is a thin, rectangular planar member. Locators, which include associated stanchions, define locations on each display unit for receiving display item holders. A cap engages each stanchion to secure the display item holders. Studs protruding along the lower edge of a unit fit into slots located along the top and sides of other units, and form a multi-unit display center. The preferred configuration is an open-faced, open-top display center having a base formed of two display units connected together, and sides and backs formed by three display units connected to and upstanding from the base. Display item holders and their contents are visible within the four interior surfaces of the display center. Means for adjusting the viewing angle of the upstanding sides of the display center is also disclosed.

22 Claims, 5 Drawing Sheets

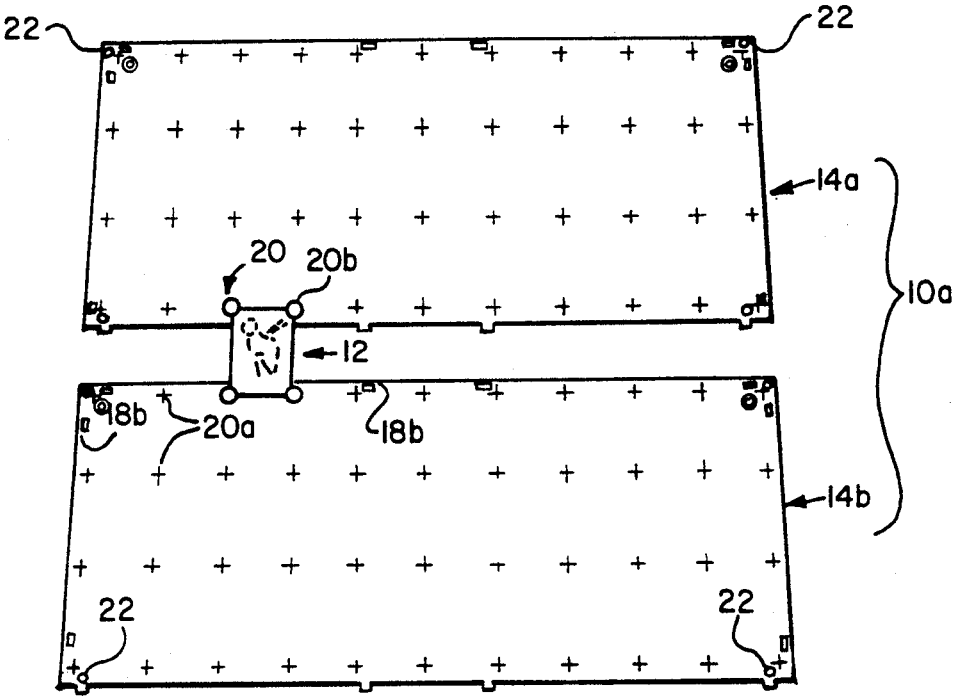
Fig. 6
Fig. 7
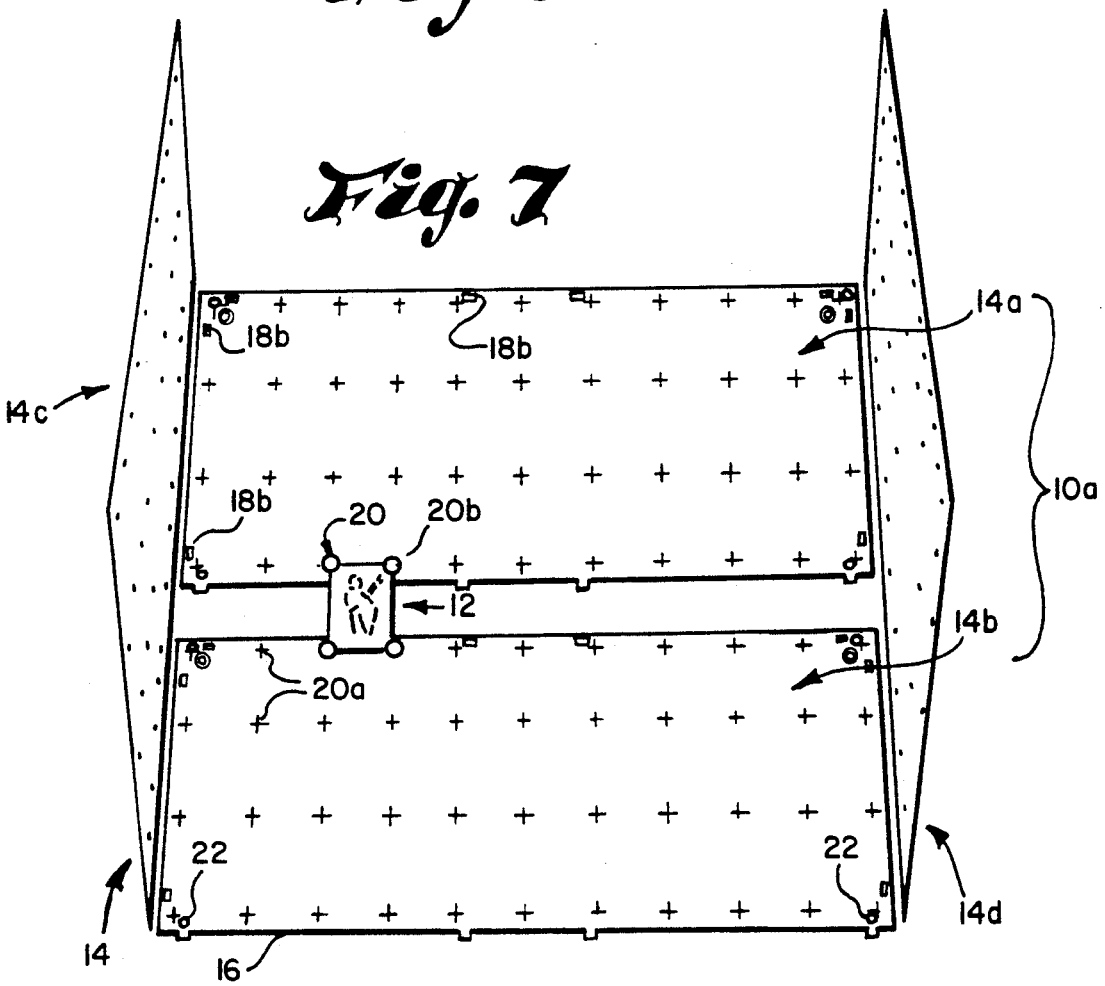

UNIT FOR DISPLAYING A PLURALITY OF ITEMS IN HOLDERS

BACKGROUND OF THE INVENTION

1. Field of the Invention

The present invention generally relates to display devices and, more particularly, is concerned with a device for displaying a multitude of display item holders.

2. Description of the Prior Art

Baseball card collecting and trading is a flourishing pastime. Thousands of aficionados frequent baseball card shops and attend weekend card shows for the purpose of acquiring new cards and trading existing cards. At any given card shop or weekend convention, thousands of baseball cards may be available for sale or trade. It is advantageous for both the owner of the cards and individuals interested in obtaining the cards that the cards be easily accessible and readily viewable.

On July 7, 1989, applicants filed a patent application, Ser. No. 07,376,816, entitled PLASTIC CARD HOLDER. In the preferred embodiment, the plastic card holder is made up of two clear plastic panels that snap firmly together and are easily removable. The invention holds, protects and displays one or more display items, such a card, including a baseball card, or other small items, such as stamps, coins, paper currency, newspaper articles and pictures. As used herein, the term "display item holder" means any device similar to the invention described in U.S. patent application Ser. No. 07,376,816. Each holder has a recess and mating protrusion on each corner that allows holders to be stacked on each other for transportation and storage, without scratching or damaging one another. An attachable device is provided for standing the holder upright and adjusting the viewing angle. The device is marketed under the name "SNAP-IT". The preferred embodiment of the present invention works in conjunction with a plurality of display item holders to provide an innovative device for displaying the card holders and, consequently, the display items. The present device is marketed under the name SNAP-IT TM "Display Center".

A variety of devices are currently in use for displaying cards. Some traders will simply arrange the available cards face up on a table top. Others use a stand in which cards are inserted into pockets or slots which are part of the stand, whereby at least a portion of the card is visible and projecting outward from the pocket or slot. Still others use a so-called "ALL STATE" display device. The "ALL STATE" case is approximately 36"×36"×2" high with a hinged plastic cover. Approximately 55 to 65 cards can be displayed. A variety of other arrangements are possible, but the general idea is to display a multitude of baseball cards in a convenient manner.

Current methods and devices suffer from a number of disadvantages. Direct manipulation of the display item, for example, the direct handling of a baseball card, may result in damage to the item or allow for possible theft of the item. In addition, a one dimensional layout of displayed items, as with a tabletop or single-faced stand arrangement, is an inefficient use of space. Some present devices are difficult to manufacture, assemble, and disassemble; others are not particularly sturdy and/or are difficult to clean.

the applicants are aware of the following U.S. Pat. Nos. concerning display devices.

| U.S. Pat. No. | Issue Date | Inventor | Title |
|---|---|---|---|
| 4,735,290 | 04/05/88 | Byrley | SYSTEM AND METHOD FOR DISPLAYING, VENDING AND CONTROLLING INVENTORY OF VALUABLE ARTICLES SUCH AS PRE-RECORDED VIDEOTAPE CASSETTES |
| 4,744,473 | 05/17/88 | Hardy | KNOCK-DOWN END CAP MERCHANDISE DISPLAY UNIT COMPRISING VERTICALLY SPACED MERCHANDISE RECEIVING TRAYS PROVIDED WITH FORWARD AND REARWARD ADJUSTMENT THEREOF |
| 4,744,474 | 05/17/88 | Tallving et al. | DISPLAY STAND |
| 4,266,771 | 05/12/81 | Carbone et al. | FLEXIBLE PLAYING CARD DISPLAY RACK |
| 4,228,904 | 10/21/80 | Dumond | STAIRSTEP DISPLAY RACK |
| 4,217,985 | 08/19/80 | Nasgowitz | DISPLAY DEVICE FOR STORING AND DISPLAYING CARDS |
| 4,217,986 | 08/19/80 | Brown | INVENTORY RESTRAINING DEVICE FOR MERCHANDISE DISPLAY HOOK |
| 4,069,941 | 01/24/78 | Popplewell et al. | ENGAGEABLE CARD RACKS |
| 4,534,473 | 08/13/85 | Zahn et al. | DISPLAY STAND |

Byrley relates to a merchandising system which includes at least one display rack for inviting customers to select specific articles. The display rack has a plurality of individual cells which are located so as to be accessible to the customers. An individual cell is capable of receiving an enveloped packet.

Hardy teaches a knock-down merchandise display rack comprising a plurality of generally vertically spaced, substantially identical trays having upwardly opening pockets. The pockets are exteriorly accessible from the respective tray for receiving and displaying merchandise, such as greeting cards.

Tallving, et al., generally relates to a product or display stand with at least two wire baskets which have upward and outward inclined sides. A frame component comprising two vertically arranged uprights engage the wire baskets in an articulated and detachable fashion. The baskets are foldable one after the other from the top downward against the uprights.

Carbone, et al., relates to a plain card display rack. A narrow box in which plain cards can be displayed in spread out position is combined with a base for holding the box upright. The rack is made of a material for selective flexing.

Dumond relates to a stair step display rack for displaying items in a stair step arrangement on horizontal surface.

Nasgowitz teaches a display device for storing and displaying a plurality of cards. The device is fitted with a plurality of display compartments for vertically stacking and displaying cards.

Brown relates to an apparatus for displaying merchandise of the type where the merchandise is attached to a card having a hole through it.

Popplewell, et al., discloses a card rack which includes a first tray section with elongated, spaced dividers that separate compartments, and a second tray section having a downwardly projecting flap attached along an edge. The flap has a plurality of slots at spaced intervals along its length. The spacing of the intervals corresponds to that of the dividers in first tray section. The flap fits inside the first tray with the dividers inserted into the slots of the flap.

Post discloses a display rack fitted with a plurality of compartments for displaying merchandise.

Each of the patents discussed above relates generally to display devices, but differ both in structure and operation from the present invention.

Applicants are unaware of any prior art that accomplishes the objects of the present invention. Consequently, a need exists for a device for viewing plurality of baseball cards, or other display items, that inhibits theft of the items, while being easily assembled and disassembled. The invention is modular, convenient to transport, and may be combined with other display units to form an expanded display center, yet is easy and inexpensive to manufacture.

SUMMARY OF THE INVENTION

The present invention is an innovative display item holder display center, which overcomes the problems and satisfies the needs considered above.

A display unit displays a plurality of display items contained in holders. Each display unit is a thin, rectangular, generally planar member. Locators, which include associated stanchions, define locations on each display unit for receiving display item holders. A cap engages each stanchion to secure the display item holders in the display unit. Holders may be easily removed by disengaging only two caps. Studs protruding along the lower edge of a unit fit into slots located along the top and sides of other mating units, and form a multi-unit display center. The preferred configuration is an open-faced, open-top display center having a base formed of two display units connected together, and sides and backs formed by three display units connected to and upstanding from the base. Display item holders and their contents are visible within the four interior surfaces of the display center. In a preferred embodiment, approximately 160 display item holders and their contents are visible within the four interior sides of the display center. Means for adjusting the viewing angle of the upstanding sides of the display center is also provided.

For ease of shipping and transporting, display units are stackable, nesting together. Display units can also be "loaded" with display item holders. Display items are simply inserted into their respective display item holders, the display unit filled with the holders, and the holders secured to the unit by installing caps. Five such "loaded" units may then be stacked and packed together to form an unassembled display center capable of being quickly assembled upon reaching its destination.

In summary, the invention encompasses a device for displaying a multitude of display item holders, composed of a plurality of display units, which form a display center. In its preferred form, each unit weighs approximately four pounds and may be assembled (or disassembled) in less than five minutes.

OBJECTS OF THE INVENTION

It is the principal object of the invention to provide means for viewing a plurality of display items.

It is another object of the invention to provide a device for viewing a plurality of display items that inhibits theft of the items.

It is another object of the invention to provide a display device that may be easily assembled and disassembled.

Another object of the invention is to provide a display unit that is modular and ma be combined with other display units to form an expanded display center.

Another object of this invention is to provide a display device that is easy and inexpensive to manufacture.

Another object of this invention is to provide a display device that may be conveniently transported.

Another object of this invention is to provide a display device that may be used in conjunction with a display item holder.

It is another object of the invention is to provide a display device that will permit easy access to the displayed item.

Another object of the invention is to provide a display device that is sturdy.

Another objective of the invention is to provide a display device that may be easily cleaned.

Another object of the invention is to provide a display unit that may be stacked, transported, and stored without scratching or damaging an adjacent display unit.

Another object of the invention is to provide a display unit for display of cards, such as baseball cards, and other small items, such as stamps, coins, paper currency, newspaper articles, and pictures.

BRIEF DESCRIPTION OF THE DRAWINGS

The foregoing and other objects will become more readily apparent by referring to the following detailed description and the appended drawings in which:

FIG. 6 is an isometric view of two display units aligned to form a base for the display center.

FIG. 7 is an isometric view of two upright side display units connected to the base shown in FIG. 6, immediately prior to the connection of an upright rear display unit to the base and side display units, as shown in FIG. 2.

DESCRIPTION OF THE PREFERRED EMBODIMENTS

Figure 1:
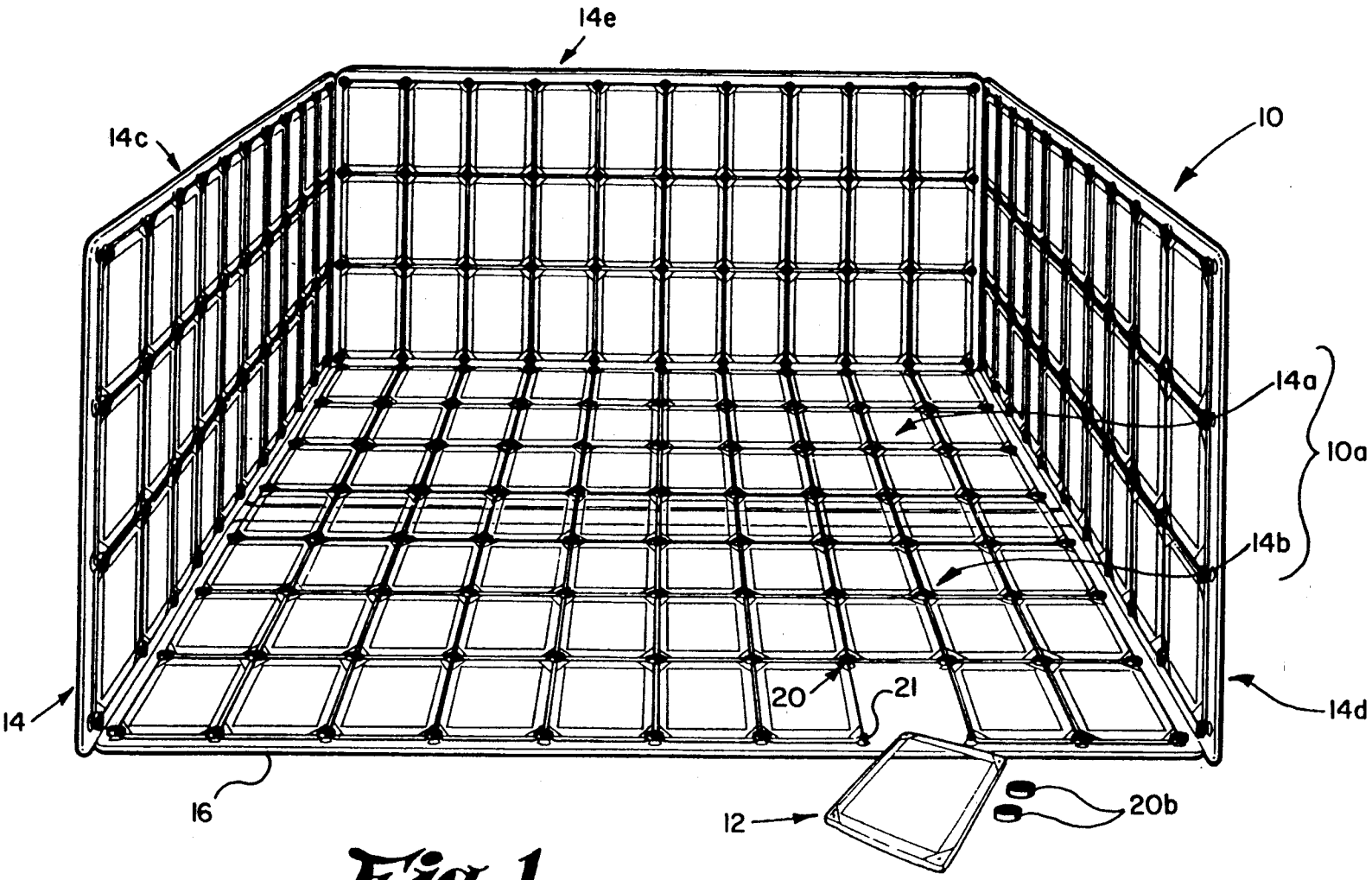
FIG. 1 is a central isometric view of the invented display center, with display item holders in place, and one holder removed.
Figure 2:
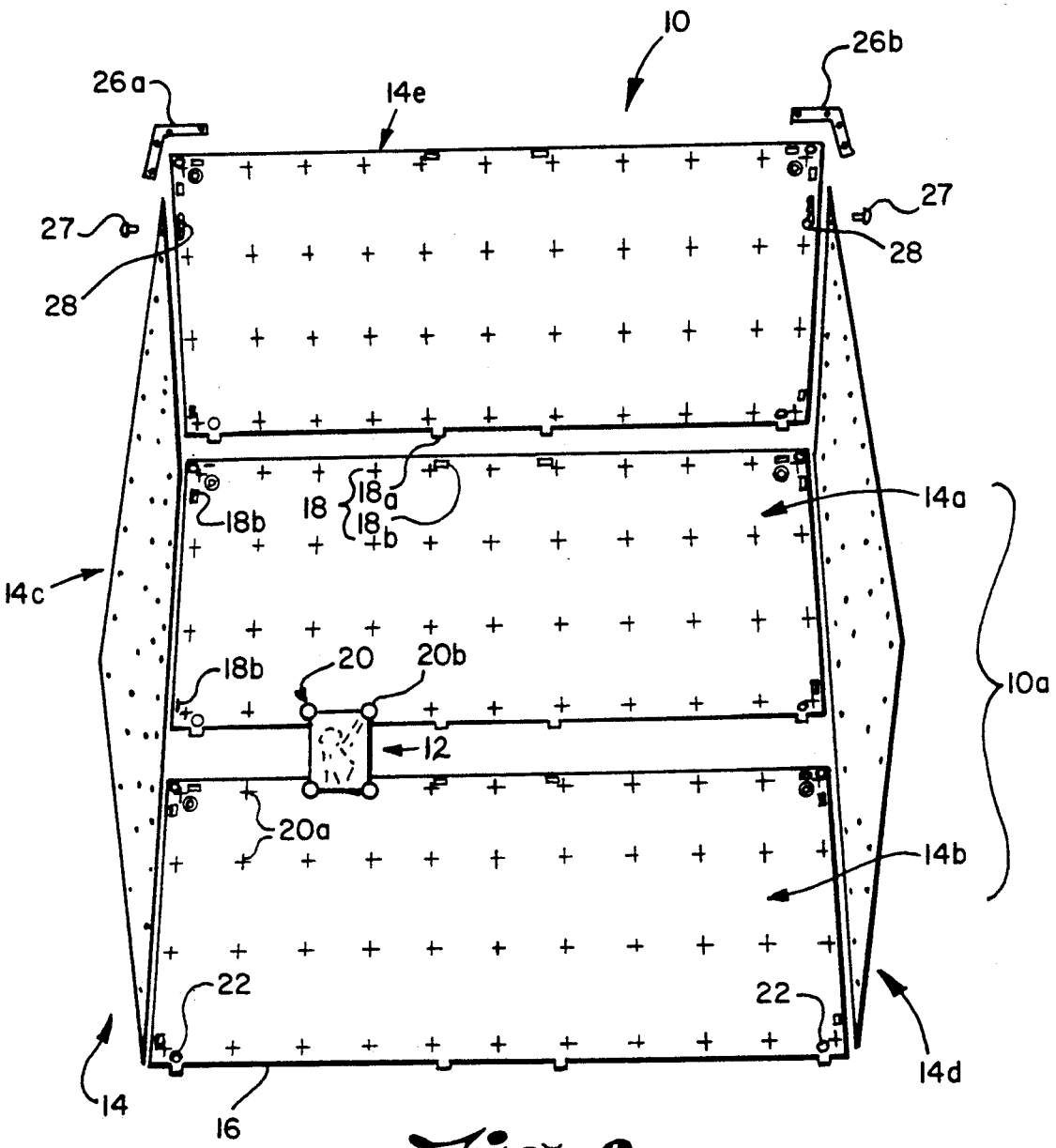
FIG. 2 is an exploded isometric view of the invention in use with a display item holder.

Referring now to the drawings, and more particularly to FIG. 1, a display center, generally designated 10, which is assembly of five mated display units 14, comprises the preferred embodiment of the present invention.

Figure 3:
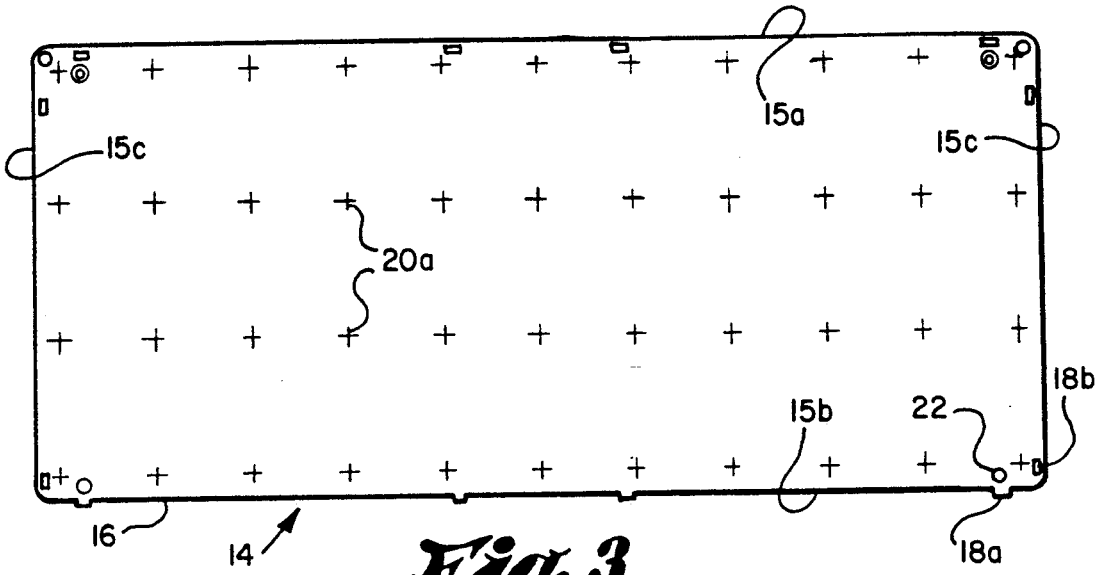
FIG. 3 is a top plan view of a display unit.
Figure 4:
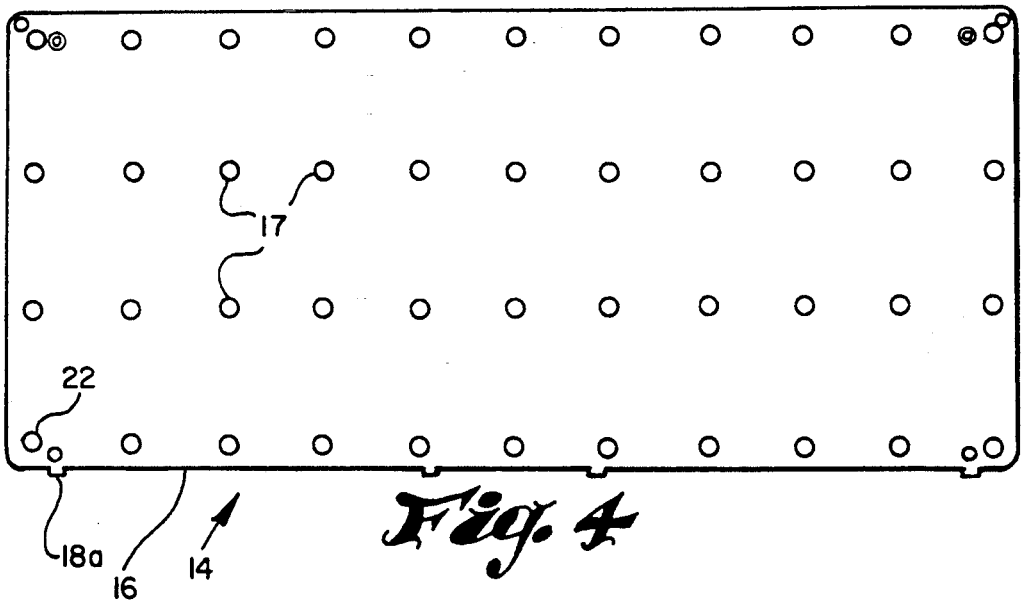
FIG. 4 is a bottom plan view of a display unit.

Display unit 14 includes a generally planar member 16, having a top surface (FIG. 3) and a bottom surface (FIG. 4), and means 20 integral with the top surface of the planar member 16 for receiving, containing and displaying a plurality of display item holders 12. A display unit 14 may further include means 18 for mating the planar member with at least one other planar member 16. A display center 10 contains and receives a plurality of display item holders 12, and includes a plurality of display units 14.

Figure 5:
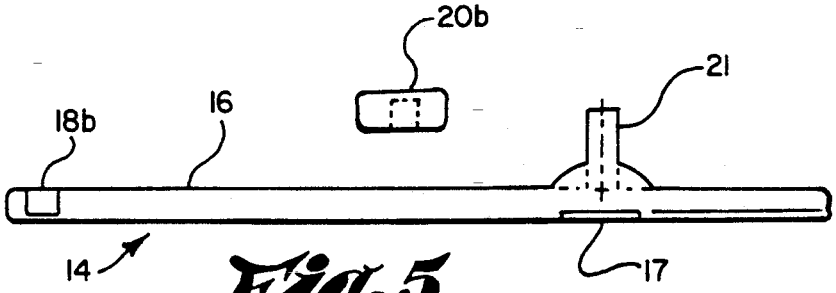
FIG. 5 is a side elevation of the display unit shown in FIGS. 3 and 4 together with cap.
Figure 8:
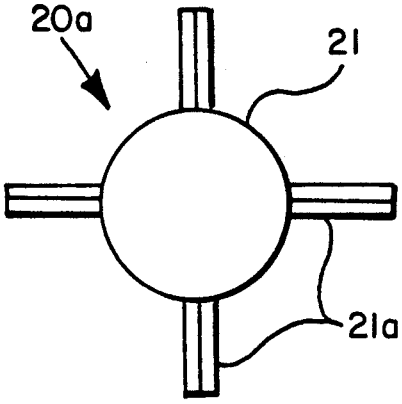
FIG. 8 is a top plan view of a locator which includes a round stanchion having four generally planar support arms extending therefrom, each support arm being perpendicular to any adjoining support arm, the four arms creating a "plus" (+) shaped configuration for receiving display item holders.

In the preferred embodiment, a display unit 14 is approximately 32 inches in length, by 14 ½ inches in width, and less than ¼ inches in thickness, and made of blue polystyrene. Alternatively, a display unit 14 may be made of a variety of rigid materials, such as wood, plastic, plexiglass, or the like. Preferably the mating means 18 includes studs 18*a* and slots 18*b*. Studs 18*a* are positioned along and protrude outwardly from the bottom edge 15*b* of each unit 14. Slots 18*b* are positioned along the periphery of the top edge 15*a* of each unit 14, corresponding to studs 18*a* on the bottom edge 15*b*. Slots 18*b* are also positioned along the periphery of both side edges 15*c* of a unit 14, adapted for mating with some, but not necessarily all, of the studs 18*a* on the bottom edge 15*b* of another unit 14. The means 20 for receiving, containing and displaying at least one display item holder 12 includes locators 20*a* fixed to and extending normally from the planar member 16, and holder retainers 20*b* adapted to engage the locators 20*a*. The holder retainers 20*b* are preferably caps 20*b*, as shown in FIG. 5, and are adapted to fit over the ends of the locators 20*a* to secure the display item holders 12 in the display unit 14. The caps 20*b* are preferably made of resilient material such as rubber or polypropylene and fit tightly over stanchions 21. Forty-four (44) locators 20*a* are aligned in horizontal and vertical rows and define thirty (30) locations on each display unit 14 for receiving thirty (30) display item holders 12. Each locator 20*a* preferably includes a stanchion 21 having four generally planar support arms 21*a* extending therefrom, each support arm 21*a* being perpendicular to any adjoining support arm 21*a*, and each support arm 21*a* extending normally from the planar member 16, the four arms creating a "plus" (+) shaped cross-section configuration for receiving display item holders 12. The bottom surface of the planar member 16 is provided with recesses 17 for receiving holder retainers 20*b* in order to facilitate stacking of planar members 16 on top of one another. Each display unit 14 may also be provided with at least one hole 22, but is preferably provided with four holes for hanging or suspending the unit 14 from a support structure, such as a ceiling or a wall.

Display units 14 are modular and may be connected to one another by connecting the studs 18*a* of one unit 14 to the slots 18*b* of another unit 14, in a particular manner. The preferred configuration is a display center 10 having a base 10*a* formed of two display units 14*a*, 14*b*, and three display units 14*c*, 14*d*, and 14*e*, connected to and upstanding from the base 10*a*, forming an open-faced, open-top structure. Specifically, in the preferred embodiment, the base 10*a* includes a first unit 14*a* and a second unit 14*b* positioned one above the other on a horizontal surface as shown in FIG. 6. A space approximately equal to the length of a display item holder 12 separates the two, thereby permitting additional holders 12 to be situated between the bottom edge 15*b* of the first unit 14*a* and the top edge 15*a* of the second unit 14*b*. A third unit 14*c* connects perpendicular to the left edge of the first and second units 14*a*, 14*b*, by mating the studs 18*a* of the third unit 14*c* with the left-hand side slots of the first and second units 14*a*, 14*b*. A fourth unit 14*d* similarly connects perpendicular to the right edge of the first and second units 14*a*, 14*b*, by mating the studs 18*a* of the fourth unit 14*d* with the righthand side slots of the first and second units 14*a*, 14*b*. A fifth unit 14*e* connects perpendicular to the top edge 15*a* of the first unit 14*a*, by mating the studs 18*a* of the fifth unit 14*e* with the top slots of the first unit 14*a*. In addition, two metal "L" brackets 26*a*, 26*b* in conjunction with four screws 27 and four associated wing nuts 28 stabilize the display center 10. A first "L" bracket 26*a* connects the top right corner of the third unit 14*c* to the top left corner of the fifth unit 14*e*, and a second "L" bracket 26*b* connects the top left corner of the fourth unit 14*d* to the top right corner of the fifth unit 14*e*. The side units 14*c*, 14*d* or rear unit 14*e* can be angled from 8 to 10 degrees from vertical by using the outside holes of the "L" brackets 26*a*, 26*b*, thereby adjusting the viewing angle.

Figure 9:
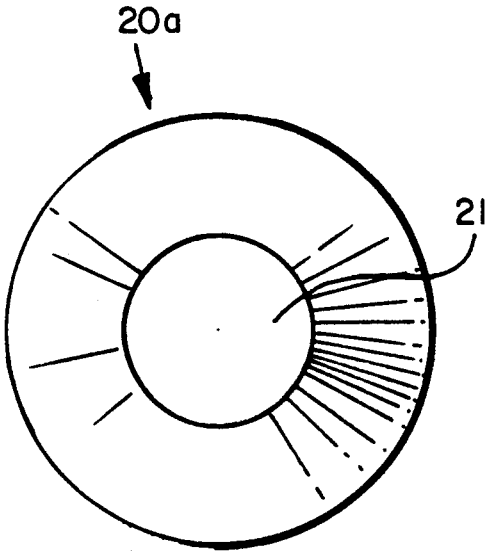
FIG. 9 is a top plan view of a locator which includes a round stanchion having a beveled base for receiving display item holders.
Figure 10:
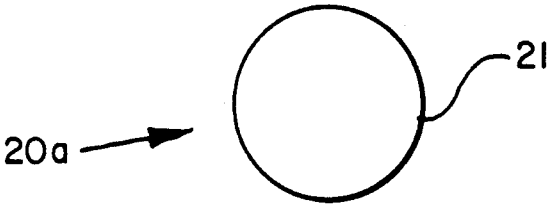
FIG. 10 is a top plan view of a locator which includes a round stanchion.
Figure 11:
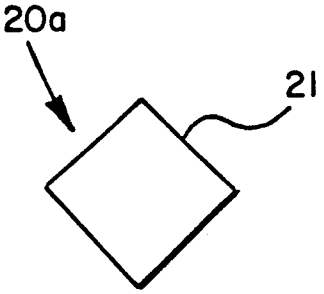
FIG. 11 is a top plan view of a locator which includes a stanchion with a diamond, shaped cross-section.
Figure 12:
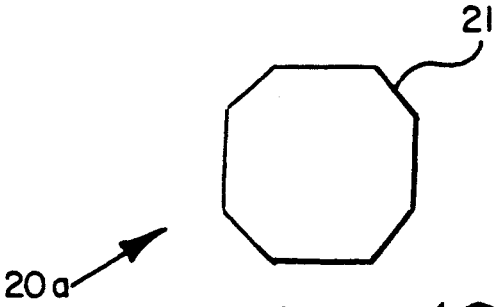
FIG. 12 is a top plan view of a locator which includes a stanchion with a polygonal cross-section.

A number of alternative embodiments are possible. For example, a first unit 14*a* and a fifth unit 14*d* may be connected in the fashion described above, but without the second, third, or fourth units 14*b*, 14*c*, and 14*d*, thus forming an "L" shaped viewing device. These two-unit devices can also be connected together to form an extended "L" shaped viewing device. In addition, although the preferred embodiment for the locators 20*a* is for the cross-section of each locator 20*a* to resemble a "plus" with a stanchion 21 in the center, alternative embodiments are also possible. For example, the base of each stanchion 21 can be beveled (See FIGS. 1, 9). In addition, the cross-section of the stanchion 21 can take a variety of shapes. The stanchion 21 can be round, as shown in FIG. 10, diamond shaped, as shown in FIG. 11, or some polyhedron shape, as shown in FIG. 12.

In operation, in the preferred embodiment, a display center 10 is assembled and used by:

positioning a first unit 14*a* and a second unit 14*b* one above the other on a horizontal surface as shown in FIG. 6, to form a base 10*a*, such that a space approximately equal to the length of a display item holder 12 separates the two, thereby permitting additional holders 12 to be situated between the bottom edge 15*b* of the first unit 14*a* and the top edge 15*a* of the second unit 14*b*;

connecting a third unit 14*c* perpendicular to the left edge of the first and second units 14*a*, 14*b*, by mating the studs 18*a* of the third unit 14*c* with the left-hand side slots of the first and second units 14*a*, 14*b*;

similarly connecting a fourth unit 14*d* perpendicular to the right edge of the first and second units 14*a*, 14*b*, by mating the studs 18*a* of the fourth unit 14*d* with the right-hand side slots of the first and second units 14*a*, 14*b*;

connecting a fifth unit 14*e* perpendicular to the top edge 15*a* of the first unit 14*a*, by mating the studs 18*a* of the fifth unit 14*e* with the top slots of the first unit 14*a*;

connecting a first "L" bracket 26*a* to the top right corner of the third unit 14*c* and to the top left corner of the fifth unit 14*e*; and connecting a second "L" bracket 26*b* to the top left corner of the fourth unit 14*d* and to the top right corner of the fifth unit 14*e*.

SUMMARY OF THE ACHIEVEMENTS OF THE OBJECTS OF THE INVENTION

From the foregoing, it is readily apparent that we have invented a device for viewing plurality of baseball cards, or other display items, that inhibits theft of the items, while being easily assembled and disassembled. The invention is modular, convenient to transport, and may be combined with other display units to form an expanded display center, yet is easy and inexpensive to manufacture.

It is to be understood that the foregoing description and specific embodiments are merely illustrative of the best mode of the invention and the principles thereof, and that various modifications and additions may be made to the device by those skilled in the art, without departing from the spirit and scope of this invention, which is therefore understood to be limited only by the scope of the appended claims.

We claim:

1. A display unit for receiving and containing a plurality of display item holders, comprising:

(a) a planar member, having a top surface and a bottom surface; and (b) means integral with said planar member top surface for receiving, containing and displaying a plurality of display item holders, including a plurality of locators fixed to and extending normally from said planar member, and holder retainers releasably engaging said locators, four adjacent said locators defining a location therebetween for retaining a single item holder, said locators being aligned in a plurality of horizontal and vertical rows defining thereby a plurality of said location on said display unit for receiving a plurality of display item holders.

2. The display unit according to claim 1, wherein said display item holder is a plastic card holder.

3. The display unit according to claim 1, wherein said holder retainers are caps adapted to fit over the ends of said locators to secure said display item holders in said unit.

4. The display unit according to claim 1, wherein each of said locators includes a stanchion having four generally planar support arms extending therefrom, each support arm being perpendicular to any adjoining support arm, and each support arm extending normally from said planar member, whereby said arms create a "plus" (+) shaped cross-section configuration for receiving display item holders.

5. The display unit according to claim 1, wherein the cross-section of each of said locators is round.

6. The display unit according to claim 5, further comprising said locator having a beveled base.

7. The display unit according to claim 1, wherein the cross-section of each of said locators is a polygon.

8. The display unit according to claim 7, wherein the cross-section of each of said locators is a diamond shape.

9. The display unit according to claim 1, wherein the bottom surface of said planar member is provided with recesses which facilitate stacking of planar members on top of one another.

10. The display unit according to claim 1, wherein said planar member is polystyrene.

11. The display unit according to claim 10, wherein said polystyrene is blue.

12. The display unit according to claim 1, wherein said planar member measures, approximately, 32 inches in length, by 14 ½ inches in width, and less than ¼ inches in thickness.

13. The display unit according to claim 1, further comprising means for mating said planar member with at least one other planar member to form a multi-unit display center.

14. The display unit according to claim 13, wherein said mating means includes studs positioned along and protruding outwardly from the bottom edge of said unit, slots positioned along the periphery of the top edge of each unit, corresponding to said studs on the bottom edge, and slots positioned along the periphery of both side edges of said unit, adapted for mating with at least some of the studs on the bottom edge of another unit.

15. The display unit according to claim 1, further comprising said unit being provided with at least one hole therethrough in a corner thereof for suspending said unit from a support structure.

16. The display unit according to claim 15, wherein said unit is provided with four holes therethrough in the corners thereof for suspending said unit from a support structure.

17. A display unit according to claim 1, further comprising:

(a) a plurality of said display units; and (b) means for connecting said display units; whereby a display center is formed.

18. The display unit according to claim 17, wherein said center includes a base and three sides, said sides connected to and upstanding from said base, whereby an open-faced, open-top structure is defined.

19. The display unit according to claim 18, wherein said base includes a first unit and a second unit positioned one above the other on a horizontal surface, separated by a space approximately equal to the length of a display item holder.

20. The display unit according to claim 19, wherein said sides include:

a third unit connected to and perpendicular to the left edge of said first and second units, the studs of said third unit being mated with the left-hand side slots of said first and second units;

a fourth unit similarly connected to and perpendicular to the right edge of said first and second units, the studs of said fourth unit being mated with the right-hand side slots of said first and second units; and a fifth unit connected to and perpendicular to the top edge of said first unit, the studs of said fifth unit being mated with the top slots of said first unit.

21. The display unit according to claim 20, further comprising:

a first "L" bracket connected to the top right corner of said third unit and to the top left corner of said fifth unit; and a second "L" bracket connected to the top left corner of said fourth unit and to the top right corner of said fifth unit.

22. The display unit according to claim 21, wherein said "L" brackets are adapted for attachment to said third, fourth, and fifth units, for adjusting of the viewing angle for viewing said display item holders.

* * * * *

UNITED STATES PATENT AND TRADEMARK OFFICE

CERTIFICATE OF CORRECTION

PATENT NO. : 5,082,122

DATED : January 21, 1992

INVENTOR(S) : Charles M. Connor, Jr., John K. Connor, H. B. Stroup, Jr.

It is certified that error appears in the above—identified patent and that said Letters Patent is hereby corrected as shown below:

Column 4, line 29, change "ma" to — may —

Column 5, line 18, delete ","

Column 7, line 62, change "defining thereby" to
— thereby defining —

Column 7, line 62, change "location" to — locations —

Signed and Sealed this

Third Day of May, 1994

Bruce Lehman

*Attest:*

BRUCE LEHMAN

*Attesting Officer*

*Commissioner of Patents and Trademarks*